US005771964A

United States Patent [19]

Bae

[11] Patent Number: 5,771,964

[45] Date of Patent: Jun. 30, 1998

[54] HEAT EXCHANGER WITH RELATIVELY FLAT FLUID CONDUITS

[75] Inventor: Young L. Bae, Grenada, Miss.

[73] Assignee: Heatcraft Inc., Grenada, Miss.

[21] Appl. No.: 634,777

[22] Filed: Apr. 19, 1996

[51] Int. Cl.[6] ..... F28F 1/02

[52] U.S. Cl. ..... 165/144; 165/177; 165/DIG. 537; 165/DIG. 457; 165/DIG. 456

[58] Field of Search ..... 165/144, 168, 165/170, 175, 177

[56] References Cited

U.S. PATENT DOCUMENTS

| | | | |
|---|---|---|---|
| 178,300 | 6/1876 | Jas | 165/168 |
| 314,945 | 3/1885 | Korting | 165/168 |
| 1,884,612 | 10/1932 | Dinzl | 165/168 |
| 1,958,899 | 5/1934 | MacAdams | 165/144 X |
| 2,017,201 | 10/1935 | Bossart et al. . | |
| 2,521,475 | 9/1950 | Nickolas | 165/175 X |
| 3,153,447 | 10/1964 | Yoder et al. | 165/175 X |
| 3,776,018 | 12/1973 | French . | |
| 4,516,632 | 5/1985 | Swift et al. . | |
| 4,932,469 | 6/1990 | Beatenbough | 165/153 |
| 4,998,580 | 3/1991 | Guntly et al. . | |
| 5,279,360 | 1/1994 | Hughes et al. . | |
| 5,341,870 | 8/1994 | Hughes et al. . | |
| 5,372,188 | 12/1994 | Dudley et al. . | |

*Primary Examiner*—Allen J. Flanigan
*Attorney, Agent, or Firm*—W. Kirk McCord

[57] ABSTRACT

An improved heat exchanger includes plural relatively flat conduits adapted to accommodate passage of heat transfer fluid therethrough. Each conduit has inlet and outlet openings, a supply channel communicating with the corresponding inlet opening to direct heat transfer fluid flowing through the corresponding inlet opening into the corresponding conduit, a drain channel communicating with the corresponding outlet opening to direct heat transfer fluid out of the corresponding conduit through the corresponding outlet opening, and plural heat transfer channels communicating between the supply and drain channels to direct heat transfer fluid therebetween in a generally transverse direction relative to respective major axes of the supply and drain channels. The supply and drain channels each have a substantially greater cross-sectional area than the cross-sectional area of each heat transfer channel. Heat transfer between the fluid inside the conduit and an external fluid, such as air, flowing through the heat exchanger occurs for the most part as heat transfer fluid flows through the heat transfer channels of the conduits. Various heat transfer channel configurations are disclosed.

20 Claims, 13 Drawing Sheets

HEAT EXCHANGER WITH RELATIVELY FLAT FLUID CONDUITS

FIELD OF INVENTION

This invention relates generally to heat exchangers having one or more relatively flat fluid conduits and in particular to a heat exchanger with improved fluid conduits.

BACKGROUND ART

Heat exchangers having fluid conduits of relatively flat cross-section are known in the art. Such heat exchangers are often referred to as "parallel flow" heat exchangers. In such parallel flow heat exchangers, the interior of each tube is divided into a plurality of parallel flow paths of relatively small hydraulic diameter (e.g., 0.070 inch or less), which are often referred to as "microchannels", to accommodate the flow of heat transfer fluid (e.g., a vapor compression refrigerant) therethrough. Parallel flow heat exchangers may be of the "tube and fin" type in which the flat tubes are laced through a plurality of heat transfer enhancing fins or of the "serpentine fin" type in which serpentine fins are coupled between the flat tubes. Heretofore, parallel flow heat exchangers typically have been used as condensers in applications where space is at a premium, such as in automobile air conditioning systems.

To enhance heat transfer between fluid such as a vapor compression refrigerant flowing inside the heat exchanger conduits and an external fluid such as air flowing through the heat exchanger, it is usually advantageous to have flow channels of relatively small hydraulic diameter. However, such small hydraulic diameters usually result in unwanted pressure drops as the fluid flows through the conduits. There is therefore a need for an improved heat exchanger to provide the advantages of relatively small hydraulic diameter flow paths, without the pressure drops which are usually associated with such relatively small hydraulic diameter flow paths.

SUMMARY OF THE INVENTION

In accordance with the present invention, a heat exchanger is provided having at least one conduit of non-circular cross-section adapted to accommodate passage of heat transfer fluid therethrough. The conduit has inlet and outlet openings, a supply channel communicating with the inlet opening to direct heat transfer fluid flowing through the inlet opening into the conduit, a drain channel communicating with the outlet opening to direct heat transfer fluid out of the conduit through the outlet opening, and plural heat transfer channels communicating between the supply channel and the drain channel. The heat transfer channels are adapted to direct heat transfer fluid from the supply channel to the drain channel in a generally transverse direction relative to respective major axes of the supply and drain channels.

In accordance with one feature of the invention, the supply and drain channels have a substantially greater cross-sectional area than the cross-sectional area of the heat transfer channels.

In accordance with another feature of the invention, the heat transfer channels are substantially shorter in length than the lengths of the supply and drain channels, as measured along their respective major axes.

In accordance with one embodiment of the invention, the conduit has first and second major surfaces in facing relationship. The heat transfer channels are comprised of plural first grooves formed on the first major surface and plural second grooves formed on the second major surface. The first and second grooves are arranged in a predetermined pattern intermediate the supply and drain channels.

In accordance with another embodiment of the invention, the first and second grooves are in parallel array and all of the grooves communicate between the supply channel and the drain channel.

In accordance with yet another embodiment of the invention, the first grooves extend at a first oblique angle relative to the respective major axes of the supply and drain channels and the second grooves extend at a second oblique angle relative to the respective major axes of the supply and drain channels, such that the first and second grooves are in crossing relationship to define a cross-hatched groove pattern. Each of the first and second grooves is blocked at one end thereof, such that each groove communicates with only one, but not both, of the supply and drain channels. Fluid flowing into the grooves which communicate with the supply channel is constrained to flow into the drain channel through other grooves which communicate with the drain channel, thereby producing turbulent mixing of the fluid for enhanced heat transfer.

In accordance with yet another embodiment of the invention, the heat transfer channels are comprised of plural first grooves arranged in a first chevron pattern and plural second grooves arranged in a second chevron pattern, which is in crossing relationship with the first chevron pattern to define a cross-hatched groove pattern. The first and second chevron patterns are adapted to direct fluid in a circuitous flow path between the supply channel and the drain channel, thereby producing turbulent mixing of the fluid for enhanced heat transfer.

In accordance with still another embodiment of the invention, the conduit has first, second and third main channels, plural feeder channels extending transversely relative to the first, second and third main channels, and plural sections of heat transfer channels. A first one or more of the feeder channels is in fluid communication with the first main channel, but not with either the second main channel or the third main channel. A second one or more of the feeder channels is in fluid communication with the second main channel, but not with either the first main channel or the third main channel. A third one or more of the feeder channels is in fluid communication with the third main channel, but not with either the first main channel or the second main channel. Each section of heat transfer channels is intermediate adjacent feeder channels and is comprised of plural heat transfer channels in fluid communication with the corresponding two adjacent feeder channels, whereby heat transfer fluid is able to flow between adjacent feeder channels via the corresponding intermediate section of heat transfer channels. The conduit is adapted to direct fluid between the first main channel and the third main channel and between the second main channel and the third main channel via the feeder channels and the heat transfer channels. The first, second and third main channels each have a substantially greater cross-sectional area than the cross-sectional area of any of the feeder channels and each of the feeder channels has a substantially greater cross-sectional area than the cross-sectional area of any of the heat transfer channels.

In accordance with the present invention, an improved heat exchanger fluid conduit is provided. The conduit has supply and drain channels and plural heat transfer channels of relatively small hydraulic diameter communicating between the supply and drain channels. The supply and drain channels have a sufficiently large cross-sectional area to maintain a required fluid flow rate in the conduit, while the relatively small hydraulic diameter heat transfer channels enhance heat transfer between the fluid as it flows through the heat transfer channels and an external fluid, such as air, moving through the heat exchanger. Because the heat transfer channels extend between the supply and drain channels, they are relatively short in length compared to the lengths of the supply and drain channels, so that the heat transfer channels can have relatively small hydraulic diameter without excessive pressure drops occurring as the fluid flows through the heat transfer channels. Further, in accordance with selected embodiments of the present invention, the heat transfer channels are arranged in a predetermined pattern to enhance turbulent mixing of the fluid for further heat transfer efficiency.

BEST MODE FOR CARRYING OUT THE INVENTION

In the description which follows, like parts are marked throughout the specification and drawings with the same respective reference numbers. The drawings are not necessarily to scale and in some instances proportion may have been exaggerated in order to more clearly depict certain features of the invention.

Figure 1:
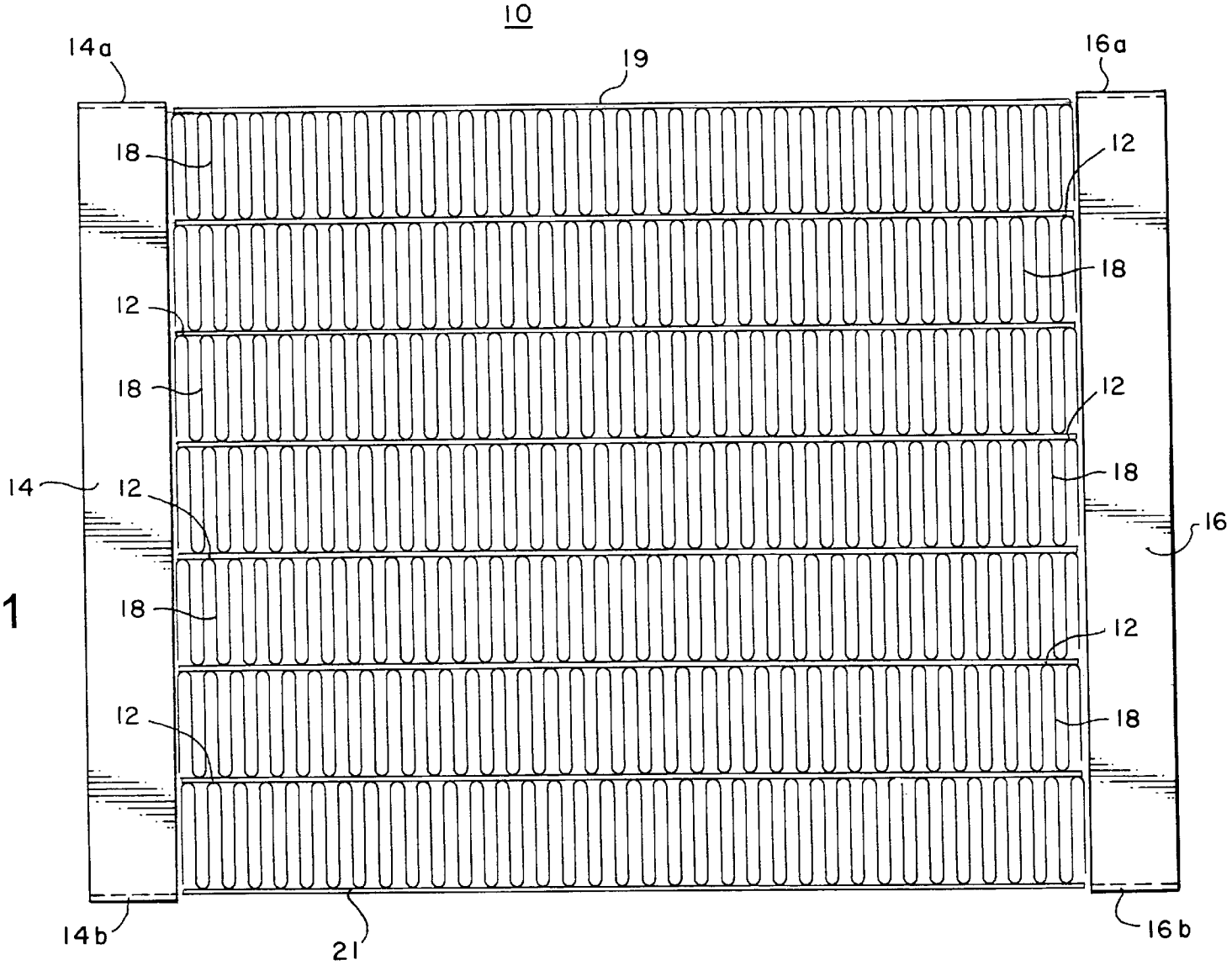
FIG. 1 is a side elevation view of an improved heat exchanger with relatively flat fluid conduits, according to the present invention.

Referring to FIG. 1, a heat exchanger 10, according to the present invention, is comprised of a plurality of elongated tubes 12 of non-circular cross-section extending between opposed inlet and outlet headers 14 and 16, respectively. Tubes 12 are preferably made of metal, such as aluminum or copper. Inlet and outlet headers 14 and 16 function as support members for supporting the weight of tubes 12. Inlet header 14 has top and bottom caps 14*a* and 14*b* to close off the top and bottom of inlet header 14. Outlet header 16 has top and bottom caps 16*a* and 16*b* to close off the top and bottom of outlet header 16. A plurality of heat transfer enhancing, serpentine fins 18 extend between and are bonded, for example, by brazing, to adjacent ones of tubes 12 and are supported thereby. Fins 18 are preferably made of metal, such as aluminum or copper. Heat exchanger 10 further includes a top plate 19 and a bottom plate 21. The uppermost fins 18 are bonded to top plate 19 and to the uppermost tube 12. The lowermost fins 18 are bonded to the lowermost tube 12 and to bottom plate 21.

Referring also to FIGS. 2–7, each tube 12 has an inlet opening 22 at one end 12*a* thereof and an outlet opening 24 at an opposite end 12*b* thereof. Inlet opening 22 is in fluid communication with inlet header 14 (FIG. 1) and outlet opening 24 is in fluid communication with outlet header 16 (FIG. 1), whereby heat transfer fluid (e.g., a vapor compression refrigerant) is able to flow from inlet header 14 through inlet opening 22 of each tube into the corresponding tube 12 and is able to flow out of each tube 12 through outlet opening 24 of the corresponding tube 12 into outlet header 16.

Figure 5:
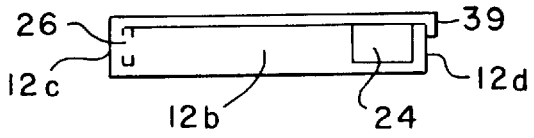
FIG. 5 is an outlet end elevation view of the conduit of FIG. 2.
Figure 4:
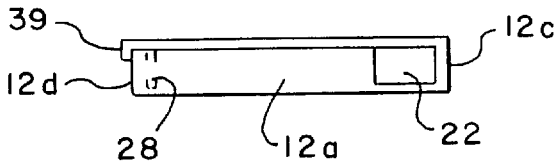
FIG. 4 is an inlet end elevation view of the conduit of FIG. 2.

Each tube 12 is relatively flat and has a substantially rectangular cross-section, as can be best seen in FIGS. 4 and 5. Each tube 12 has a major dimension extending between inlet and outlet ends 12*a* and 12*b* thereof and a minor dimension extending between opposed sides 12*c* and 12*d* thereof A supply channel 26 extends along the major dimension of each tube 12, adjacent side 12*c* thereof, and a drain channel 28 extends along the major dimension of each tube 12, adjacent side 12*d* thereof A plurality of heat transfer channels 30 in parallel array extend along the minor dimension of tube 12 between supply and drain channels 26 and 28. Relatively thin walls 32 separate adjacent channels 30. As can be best seen in FIG. 3, each channel 30 has a generally rectangular cross-section.

In accordance with a feature of the invention, each heat transfer channel 30 has a relatively small hydraulic diameter (e.g., 0.01 to 0.20 inch). Supply and drain channels 26 and 28 each have a substantially greater cross-sectional area than the cross-sectional area of each channel 30 so as to maintain sufficient fluid flow rate through channels 30 without excessive pressure drops. For example, the cross-sectional area of each Channel 26, 28 may be 5–100 times greater than the cross-sectional area of each channel 30. Hydraulic Diameter is computed according to the following generally accepted formula:

$$HD = \frac{4 \times A}{WP}$$

Where HD=hydraulic diameter

A=cross-sectional area of the corresponding channel

WP=wetted perimeter of the corresponding channel cross-section

Figure 6:
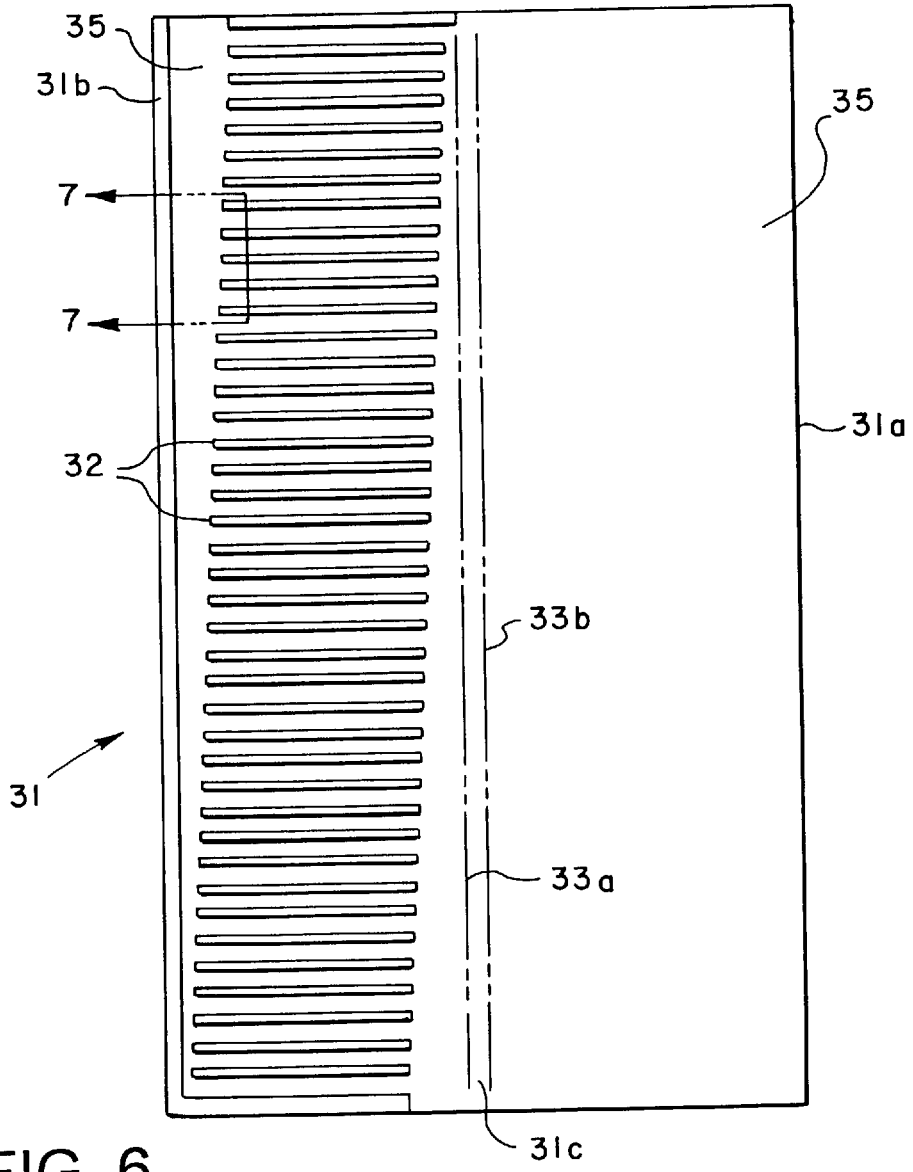
FIG. 6 is a top plan view of a plate from which the conduit of FIG. 2 is assembled.
Figure 7:
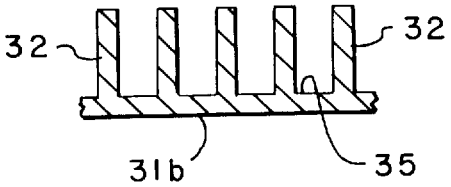
FIG. 7 is a sectional view, taken along the line 7—7 of FIG. 6.
Figure 11:
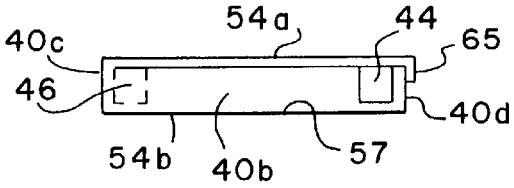
FIG. 11 is an outlet end elevation view of the conduit of FIG. 8.
Figure 8:
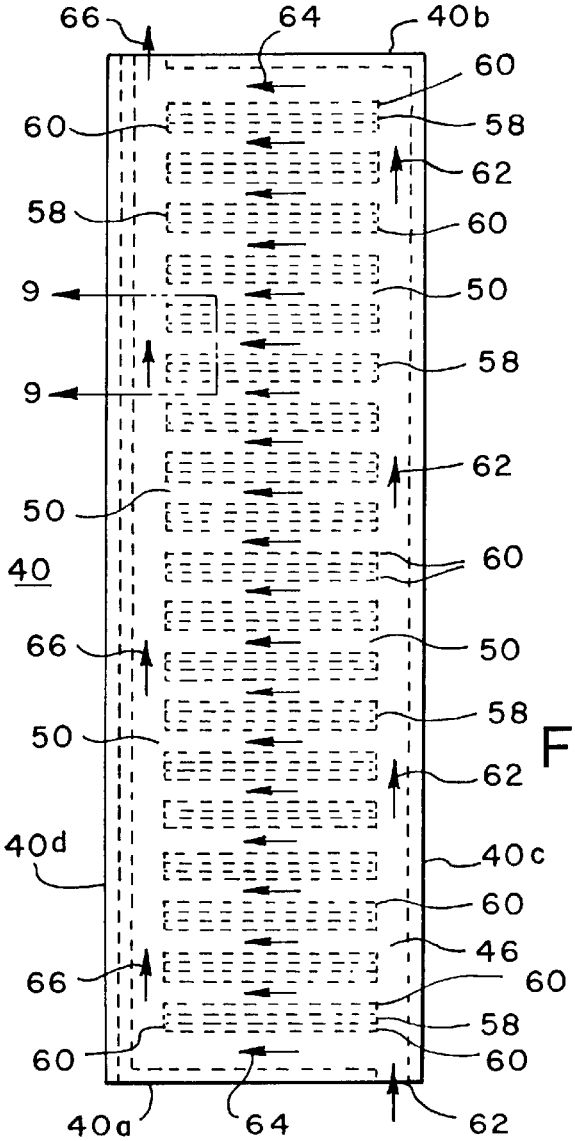
FIG. 8 is a top plan view of a second embodiment of an improved heat exchanger fluid conduit, according to the present invention.
Figure 9:
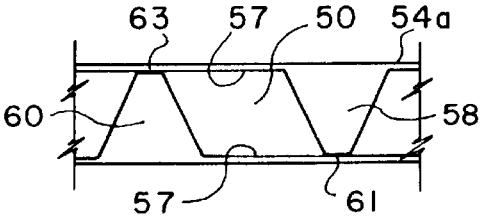
FIG. 9 is a sectional view, taken along the line 9—9 of FIG. 8.

Referring also to FIGS. 6 and 7, tube 12 is assembled by bending a relatively flat plate 31 upwardly along an axis 33*a* and folding a right portion 31*a* of plate 31 (as viewed in FIG. 6) along an axis 33*b* over the top of a left portion 31*b* of plate 31. Portion 31*c* of plate 31 is intermediate portions 31*a*, 31*b* and is defined by axes 33*a*, 33*b*. Plate 31 has a relatively flat major surface 35, punctuated by plural upstanding walls 32 on left portion 31*b*. When right portion 31*a* is folded over the top of left portion 31*b*, major surface 35 of right portion 31*a* is in contact with respective top edges of walls 32, as can be best seen in FIG. 3, and is brazed to the respective top edges, as indicated at 37, to join portions 31*a*, 31*b*. Each channel 30 is defined by two adjacent walls 32 and the respective major surfaces 35 of portions 31*a*, 31*b*, which are in facing relationship, as can be best seen in FIG. 3. As can be best seen in FIGS. 4 and 5, portion 31*a* (which is now the top portion of tube 12) has an extension lip 39, which overlaps one side of portion 31*b* (which is now the bottom portion of tube 12) and forms a part of side of 12*d* of tube 12. Portions 31*a*, 31*b* are further joined by braze-connecting lip 39 to portion 31*b* along side 12*d* and by brazing along ends 12*a*, 12*b*. Side 12*c* (FIGS. 2, 3 and 5) is defined by portion 31*c* (FIG. 6).

Figure 2:
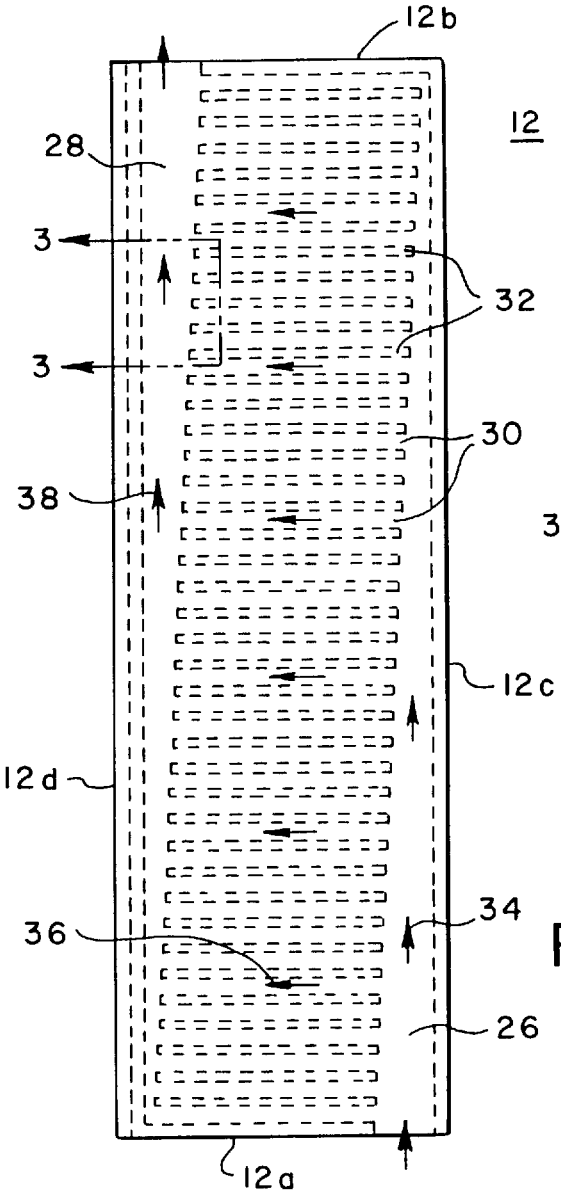
FIG. 2 is a top plan view of a first embodiment of an improved heat exchanger fluid conduit, according to the present invention.
Figure 3:
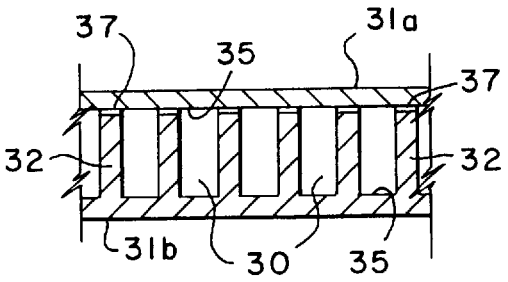
FIG. 3 is a sectional view, taken along the line 3—3 of FIG. 2.

In operation, heat transfer fluid flowing into tube 12 through inlet opening 22 flows into supply channel 26. Fluid flows through supply channel 26 in the direction of arrows 34 (FIG. 2). Fluid also flows across tube 26 through the various channels 30, as indicated by flow arrows 36, into drain channel 28, whereupon the fluid is exhausted from tube 12 through outlet opening 24, as indicated by flow arrows 38. Therefore, the flow of heat transfer fluid through tube 12 is along the major dimension thereof in supply and drain channels 26 and 28, but along the minor dimension thereof in heat transfer channels 30. Because channels 30 extend along the minor dimension of tube 12, their lengths can be made relatively short so that the hydraulic diameter of each channel 30 can be made relatively small for enhanced heat transfer without unwanted pressure drops. For example, if the length of tube 12 along its major dimension is approximately 6–36 inches, each channel 30 may be approximately 1–6 inches. Heat transfer between the fluid inside tube 12 and an external fluid, such as air, flowing across the outside of tube 12 occurs for the most part is the internal heat transfer fluid flows through channels 30. As can be best seen in FIG. 2, supply and drain channels 26 and 28 have a substantially rectangular cross-section and are tapered such that supply channel 26 is tapered gradually downwardly from inlet end 12*a* to outlet end 12*b*, while drain channel 28 is tapered gradually downwardly from outlet end 12*b* to inlet end 12*a*. Both supply and drain channels 26 and 28 extend the entire length of tube 12, as measured along the major dimension of tube 12.

Referring to FIGS. 8–13, a second embodiment of a heat exchanger tube 40, according to the present invention, is depicted. Tube 40 is relatively flat with a generally rectangular cross-section, as can be best seen in FIGS. 10 and 11, and has an inlet opening 42 at an inlet end 40*a* thereof and an outlet opening 44 at an outlet end 40*b* thereof. Tube 40 has a major dimension extending between ends 40*a* and 40*b* and a minor dimension extending between opposed sides 40*c* and 40*d* of tube 40. Tube 40 further includes a supply channel 46 extending along the major dimension, adjacent side 40*c* thereof, and a drain channel 48 extending along the major dimension, adjacent opposite side 40*d*. Supply and drain channels 46 and 48 have a substantially constant cross-sectional area (e.g., 0.005–0.200 square inch) along their respective lengths. A plurality of heat transfer channels 50 extend generally along a minor dimension of tube 40 between supply and drain channels 46 and 48. Channels 50 have a generally parallelogram-shaped cross-section, as can be best seen in FIG. 9.

Figure 12:
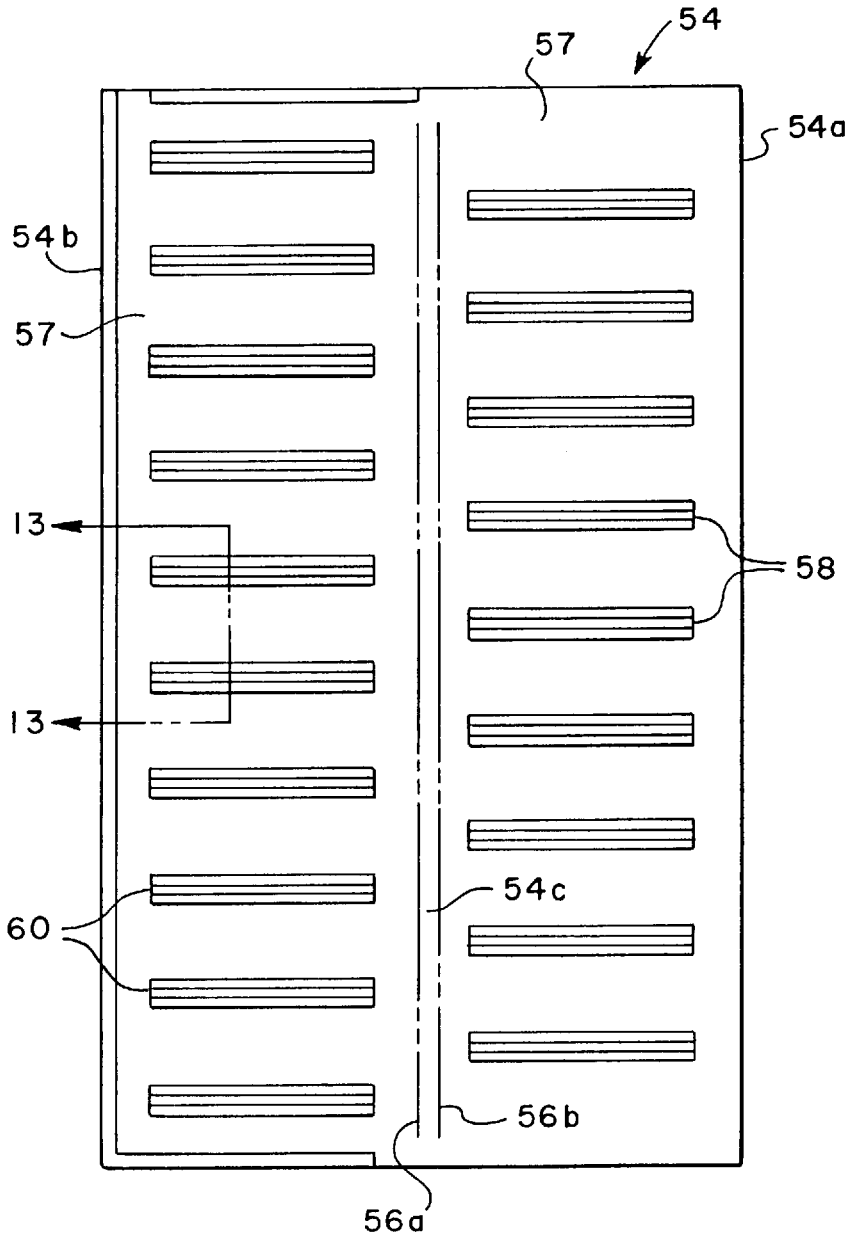
FIG. 12 is a top plan view of a plate from which the conduit of FIG. 8 is assembled.
Figure 13:
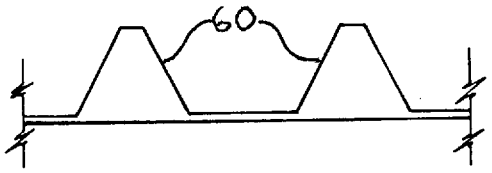
FIG. 13 is a sectional view, taken along the line 13—13 of FIG. 12.

As can be best seen in FIGS. 12 and 13, tube 40 is assembled by bending a plate 54 upwardly along an axis 56*a* and folding a right portion 54*a* of plate 50 along an axis 56*b* over the top of a left portion 54*b* of plate 50. Portion 54*c* is intermediate portions 54*a*, 54*b* and is defined by axes 56*a*, 56*b*. Plate 54 has a relatively flat major surface 57, punctuated by plural first ridges 58 on a right portion 54*a* (as viewed in FIG. 12) of plate 54 and plural second ridges 60 on a left portion 54*b* of plate 54. Ridges 58, 60 have a generally triangular cross-section and are staggered so that when portion 54*a* is folded over portion 54*b* to form tube 40, each ridge 58 is intermediate two adjacent ridges 60, ridges 58 are in contact with major surface 57 of portion 54*b* and ridges 60 are in contact with major surface 57 of portion 54*a*, as can be best seen in FIG. 9. The apex of each ridge 58 is braze-connected to major surface 57 of portion 54*b*, as indicated at 61 in FIG. 9, and the apex of each ridge 60 is braze-connected to major surface 57 of portion 54*a*, as indicated at 63 in FIG. 9. Each channel 50 is defined by adjacent ridges 58, 60 and by facing major surfaces 57 of portions 54*a*, 54*b*, as can be best seen in FIG. 9.

Figure 10:
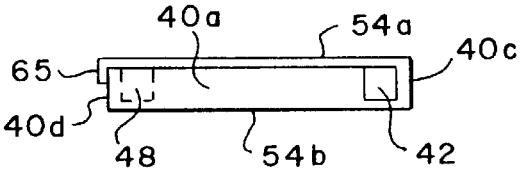
FIG. 10 is an inlet end elevation view of the conduit of FIG. 8.

As can be best seen in FIGS. 10 and 1, portion 54*a* has an extension lip 65, which overlaps portion 54*b* and forms a part of side 40*d*. Portions 54*a*, 54*b* are 20 further joined by braze-connecting lip 65 to portion 54*b* along side 40*d* and by brazing along ends 40*a*, 40*b*. When tube 40 is assembled, portion 54*a* defines a top part of tube 40 and portion 54*b* defines a bottom part of tube 40.

Heat transfer channels 50 have a relatively small hydraulic diameter (e.g., 0.01 to 0.20 inch). Supply channel 46 and drain channel 48 each have a substantially greater cross-sectional area (e.g.,5–100 times greater) than the cross-sectional area of each channel 50 to maintain sufficient fluid flow rate through channels 50. In operation, heat transfer fluid enters tube 40 through inlet opening 42 and flows into supply channel 46. As indicated by flow arrows 62, the direction of flow of the heat transfer fluid in supply channel 46 is along the major dimension of tube 40. Fluid also flows through channels 50 generally along the minor dimension of tube 40, as indicated by flow arrows 64, between supply channel 46 and drain channel 48. Fluid flows through drain channel 48 generally along the major dimension of tube 40, as indicated by flow arrows 66, and is exhausted from tube 40 through outlet opening 44. The relatively small hydraulic diameter of each channel 50 enhances heat transfer between the fluid inside tube 40 and an external fluid and the relatively short length (e.g., 1–6 inches) of each channel 50 in relation to the overall length of tube 40 (e.g., 6–36 inches) inhibits unwanted pressure drops as the fluid flows through tube 40.

Figure 17:
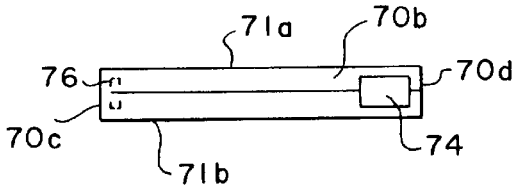
FIG. 17 is an outlet end elevation view of the conduit of FIG. 14.
Figure 14:
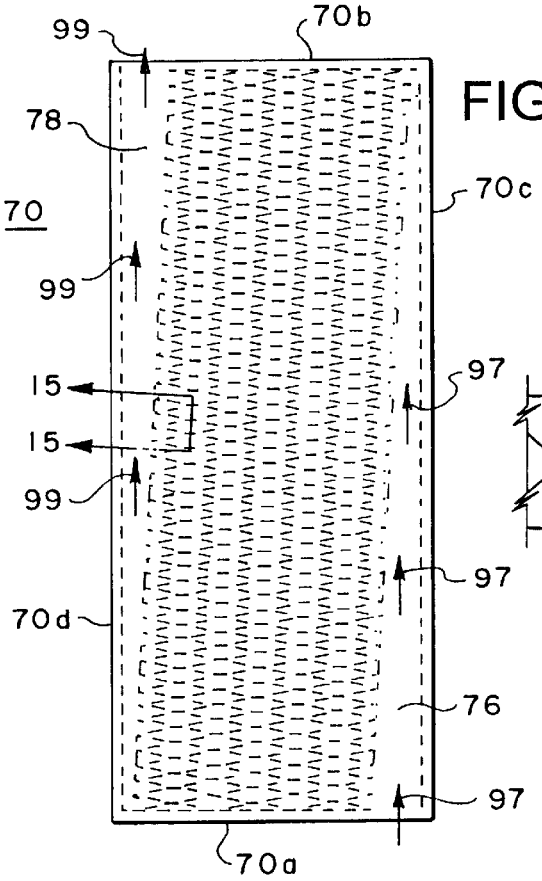
FIG. 14 is a top plan view of a third embodiment of an improved heat exchanger fluid conduit, according to the present invention.
Figure 15:
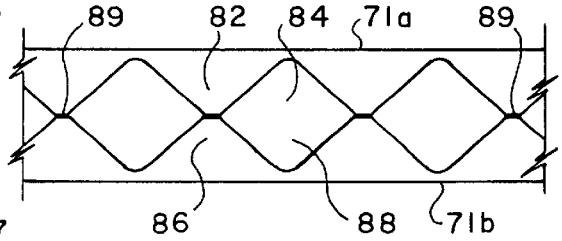
FIG. 15 is a sectional view, taken along the line 15—15 of FIG. 14.
Figure 16:
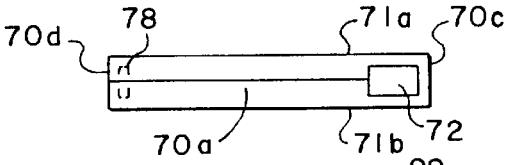
FIG. 16 is an inlet end elevation view of the conduit of FIG. 14.

Referring now to FIGS. 14–20, a third embodiment of a heat exchanger tube 70, according to the present invention, is depicted. Tube 70 is relatively flat with a generally rectangular cross-section, as can be best seen in FIGS. 16 and 17. Tube 70 further includes an inlet opening 72 at an inlet end 70*a* thereof and an outlet opening 74 at an outlet end 70*b* thereof. Tube 70 has a major dimension extending between ends 70*a* and 70*b* and a minor dimension extending between opposed sides 70*c* and 70*d* of tube 70. The interior of tube 70 includes a supply channel 76, which extends along the major dimension, adjacent side 70*c*, and a drain channel 78, which also extends along the major dimension, adjacent opposite side 70*d*. Supply channel 76 is tapered such that the cross-sectional area thereof decreases gradually in a direction from inlet end 70*a* to outlet end 70*b*. Drain channel 78 is also tapered such that the cross-sectional area thereof decreases gradually from outlet end 70*b* to inlet end 70*a*. Both supply and drain channels 76 and 78 extend substantially the entire length of tube 70, as measured along the major dimension thereof Tube 70 is assembled by bending a plate 71 upwardly along an axis 73*a* and folding a right portion 71*a* (as viewed in FIG. 17) of plate 71 along an axis 73*b* over the top of a left portion 71*b* of plate 71. A portion 71*c* of plate 71 is intermediate portions 71*a*, 71*b* and is defined by axes 73*a*, 73*b*. Plate 71 has a relatively flat major surface 80, punctuated by plural first ridges 82 of generally triangular cross-section, which define corresponding generally triangular first grooves 84 between adjacent first ridges 82 and plural second ridges 86 of generally triangular cross-section, which define corresponding generally triangular second grooves 88 between adjacent second ridges 86. When right portion 71*a* is folded over left portion 71*b*, first ridges 82 and first grooves 84 are in parallel array and extend at a first oblique angle relative to the major dimension of tube 70. Second ridges 86 and second grooves 88 are also in parallel array and extend at a second oblique angle relative to the major dimension of tube 70. First ridges 82 and first grooves 84 are in crossing relationship with second ridges 86 and second grooves 88 to define a cross-hatched pattern of grooves 84, 88, as can be best seen in FIGS. 14 and 18. Each groove 84, 88 defines a heat transfer channel. Where ridges 82, 86 cross, they are in contact and are preferably joined at the crossing points by brazing or the like to secure right and left portions 71*a*, 71*b*, as indicated at 89 in FIG. 15. Right and left portions 71*a*, 71*b* are also preferably joined by brazing along ends 70*a*, 70*b* and along side 70*d*. Intermediate portion 71*c* (FIG. 19) defines side 70*c* (FIGS. 14, 16 and 17).

Figure 18:
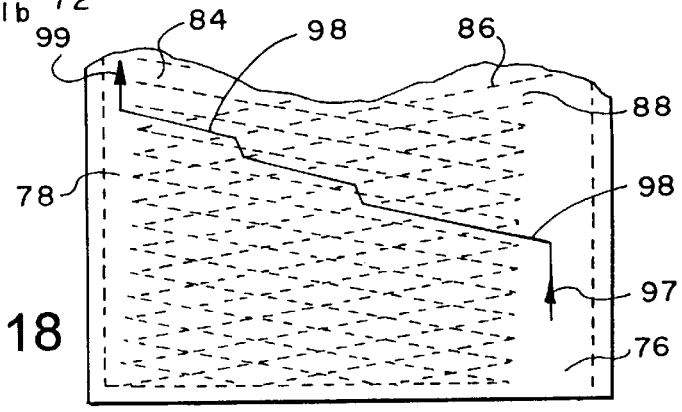
FIG. 18 is a top plan view of a portion of the conduit of FIG. 14, illustrating a fluid flow path in the conduit of FIG. 14.
Figure 19:
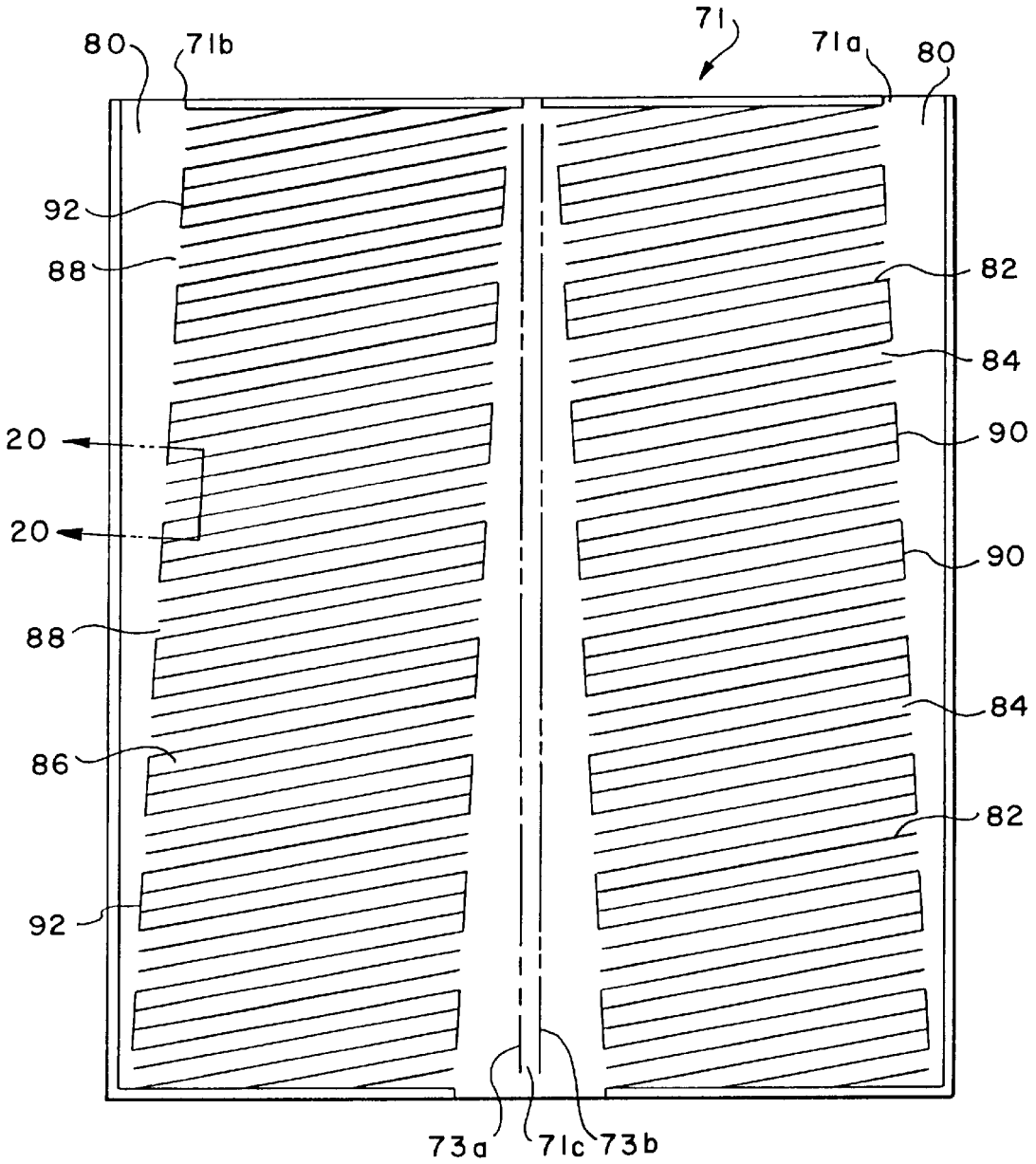
FIG. 19 is a top plan view of a plate from which the conduit of FIG. 14 is assembled.
Figure 20:
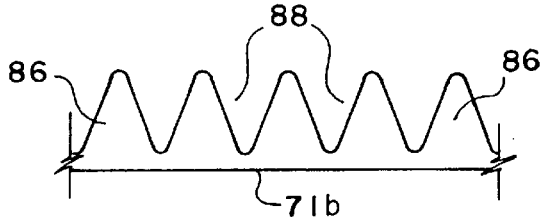
FIG. 20 is a sectional view, taken along the line 20—20 of FIG. 19.
Figure 24:
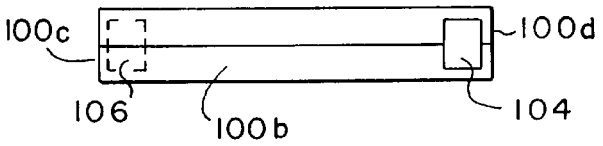
FIG. 24 is an outlet end elevation view of the conduit of FIG. 21.

To enhance turbulent mixing of the heat transfer fluid flowing through grooves 84, 88, each first groove 84 is blocked at one end thereof, as indicated at 90, and communicates with one (but not both) of supply channel 76 and drain channel 78 at an opposite end of the corresponding groove 84. Similarly, each second groove 88 is blocked at one end thereof, as indicated at 92, and communicates with one (but not both) of supply channel 76 and drain channel 78 at an opposite end of the corresponding groove 88. Therefore, fluid flowing through grooves 84, 88 is directed in a non-straight line path between supply channel 76 and drain channel 78, as indicated by flow path 98 in FIG. 18. Each time fluid changes directions corresponds to a change in the flow path from a first groove 84 (i.e., an upper groove) to a second groove 88 (i.e., a lower groove) or vice-versa. Because grooves 84, 88 are in crossing relationship, turbulent mixing is enhanced whenever the flow path changes directions. Flow path 98 in FIG. 18 is for example purposes only. One skilled in the art will recognize that fluid may flow along many different paths between supply and drain channels 76 and 78, but that the cross-hatched groove pattern and the blocking of one end of each groove 84, 88 prevents a straight line fluid flow path between supply and drain channels 76 and 78.

In operation, fluid enters tube 70 through inlet opening 72 and flows through supply channel 76 generally along the major dimension of tube 70, as indicated by flow arrows 97. Fluid flows in a non-straight line path through the heat transfer channels defined by grooves 84, 88, generally along the minor dimension of tube 70 between supply channel 76 and drain channel 78. The length of the heat transfer channel flow paths is relatively short (e.g., 1–6 inches) in relation to the overall length (e.g., 6–36 inches) of tube 70. The hydraulic diameter of each groove 84, 88 (e.g., 0.01 to 0.20 inch) is relatively small to enhance heat transfer between the fluid inside tube 70 and an external fluid as the internal fluid flows through grooves 84, 88. Supply channel 76 and drain channel 78 each have a cross-sectional area which is substantially greater (e.g., 5–100 times greater) than the cross-sectional area of the heat transfer channel defined by each groove 84, 88. The relatively short length of each groove 84, 88 and the relatively large cross-sectional areas of channels 76 and 78 allow the hydraulic diameter of each groove 84, 88 to be relatively small without causing unwanted pressure drops. Fluid flows through drain channel 78 generally along the major dimension of tube 70, as indicated by flow arrows 99, and exits tube 70 through outlet opening 74.

Figure 21:
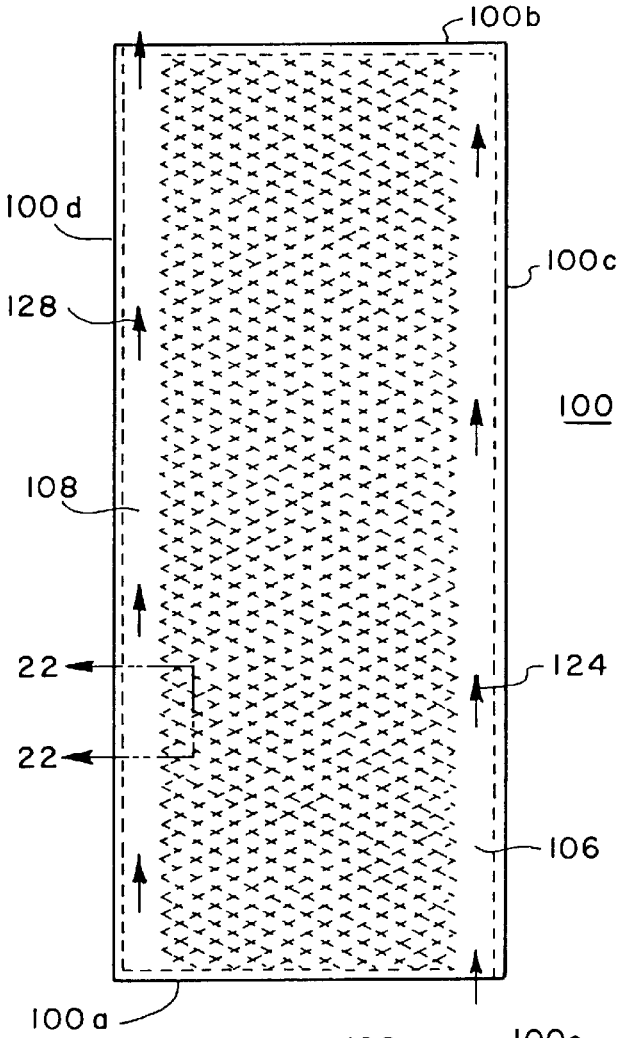
FIG. 21 is a top plan view of a fourth embodiment of an improved heat exchanger fluid conduit, according to the present invention.
Figure 23:
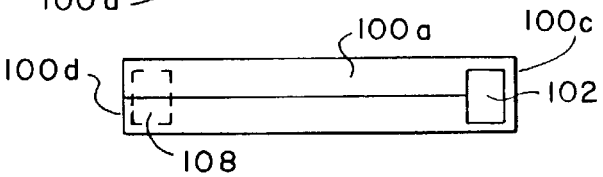
FIG. 23 is an inlet end elevation view of the conduit of FIG. 21.
Figure 22:
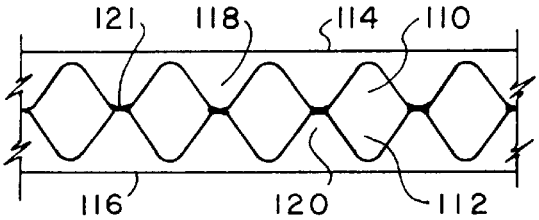
FIG. 22 is a sectional view, taken along the line 22—22 of FIG. 21.
Figure 25:
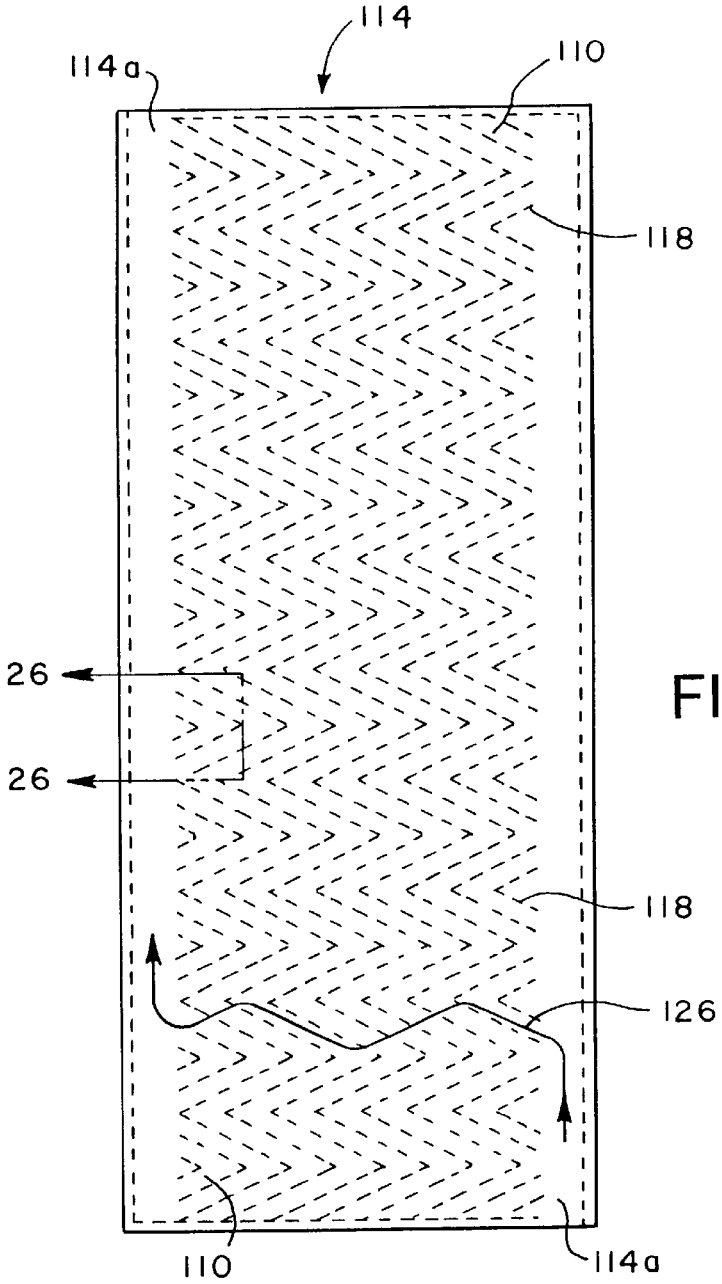
FIG. 25 is a top plan view of a top member of the conduit of FIG. 21.
Figure 27:
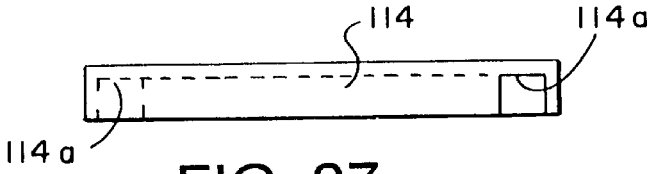
FIG. 27 is an inlet end view of the top member of FIG. 25, an opposed outlet end view being a mirror image thereof.
Figure 26:
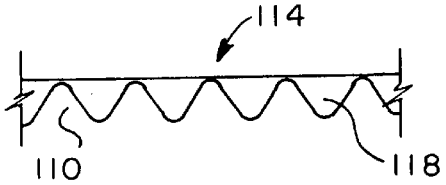
FIG. 26 is a sectional view, taken along the line 26—26 of FIG. 25.

Referring to FIGS. 21–30, a fourth embodiment of a heat exchanger tube 100, according to the present invention, is depicted. Tube 100 has an inlet opening 102 at an inlet end 100*a* thereof and an outlet opening 104 at an outlet end 100*b* thereof. Tube 100 has a major dimension extending between ends 100*a* and 100*b* and a minor dimension extending between opposed sides 100*c* and 100*d* of tube 100. The interior of tube 100 includes a supply channel 106, which extends along the major dimension, adjacent side 100*c*, and a drain channel 108, which also extends along the major dimension, adjacent opposite side 100*d*. The heat transfer channels are intermediate supply and drain channels 106, 108 and are comprised of plural first grooves 110 (FIG. 25) arranged in a first chevron pattern and plural second grooves 112 (FIG. 28) arranged in a second chevron pattern, which is in crossing relationship with the first chevron pattern to define a cross-hatched groove pattern, as shown in FIG. 21. Each groove 110, 112 has a relatively small hydraulic diameter (e.g., 0.01 to 0.20 inch) for enhanced heat transfer. Supply channel 106 and drain channel 108 each have a substantially greater cross-sectional area (e.g., 5–100 times greater) than the crosssectional area of the heat transfer channel defined by each groove 110, 112.

Figure 28:
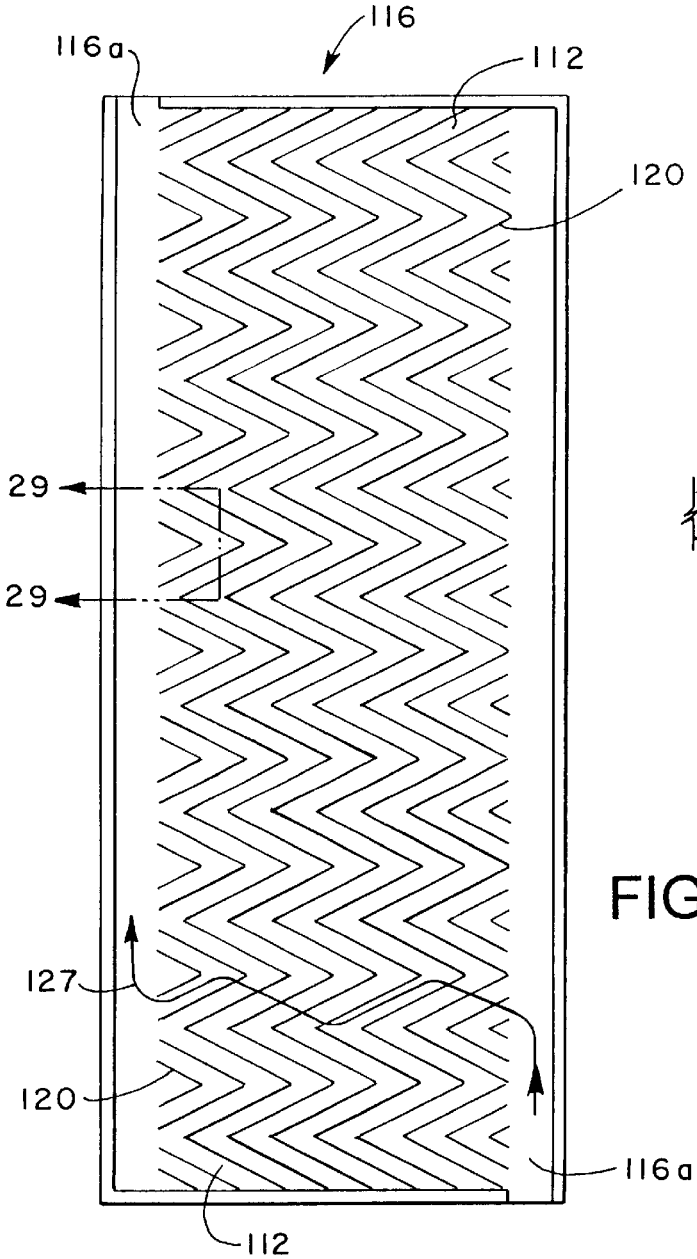
FIG. 28 is a top plan view of a bottom member of the conduit of FIG. 21.
Figure 29:
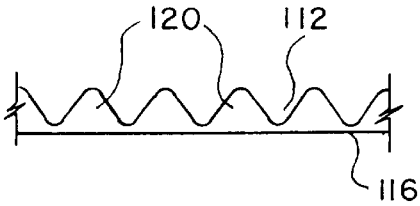
FIG. 29 is a sectional view, taken along the line 29—29 of FIG. 28.
Figure 30:
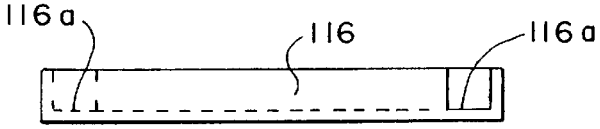
FIG. 30 is an inlet end view of the bottom member of FIG. 28, an opposed outlet end view being a mirror image thereof.

Tube 100 is comprised of a first (top) member 114 (FIG. 25) and a second (bottom) member 116 (FIG. 28). Top member 114 has a major surface 114*a* punctuated by a plurality of first ridges 118, having a generally triangular cross10 section, which define corresponding first grooves 110 with a generally triangular cross-section between adjacent ones of first ridges 118. Bottom member 116 has a major surface 116*a* punctuated by a plurality of second ridges 120 having a generally triangular cross-section, which define corresponding second grooves 112 with a generally triangular cross-section between adjacent ones of second ridges 120.

Tube 100 is assembled by positioning top member 114 on top of bottom member 116, with major surfaces 114*a*, 116*a* in facing relationship and with ridges 118, 120 in crossing relationship and in contact at the crossing points. Top and bottom members are preferably braze-connected at the crossing points, as indicated at 121, to secure top and bottom members 114, 116 together. Top and bottom members 114, 116 are preferably further secured by brazing along ends 100*a*, 100*b* and along sides 100*c*, 100*d*.

In operation, fluid entering tube 100 flows through inlet opening 102 and into supply channel 106. The flow of fluid through supply channel 106 is generally along the major dimension of tube 100, as indicated by flow arrows 124 in FIG. 21. Fluid also flows through grooves 110, 112 in a circuitous flow path, such as flow paths 126, 127 shown in FIGS. 25 and 28, from supply channel 106 to drain channel 108. As can be best seen in FIGS. 25 and 28, selected ones of the first grooves 110 and selected ones of the second grooves 112 are in fluid communication with supply channel 106, while selected other ones of the first grooves 110 and selected other ones of the second grooves 112 are in fluid communication with drain channel 108. Therefore, fluid is directed through multiple grooves 110, 112 as it passes through the heat transfer channels between supply channel 106 to drain channel 108. The circuitous fluid flow paths enhance turbulent mixing of the fluid within the heat transfer channels, thereby enhancing heat transfer between the fluid and an external fluid flowing across the outside of tube 100. Fluid flows through drain channel 108 as indicated by flow arrows 128.

Figure 31:
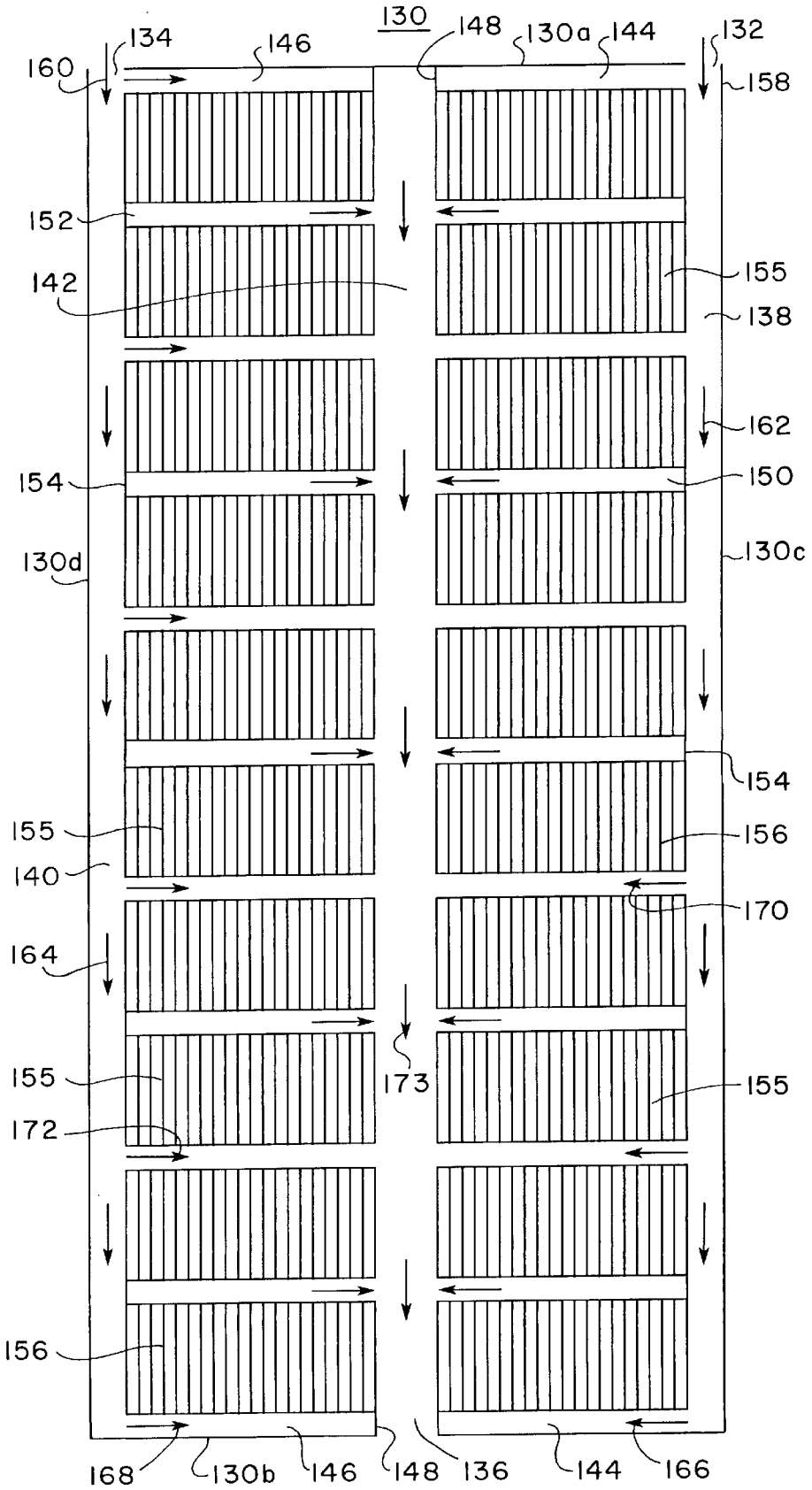
FIG. 31 is a top plan view of a fifth embodiment of an improved heat exchanger fluid conduit, according to the present invention.

Referring to FIG. 31, a plate-type heat exchanger conduit 130, according to the present invention, is depicted. Conduit 130 has two openings 132 and 134 at a first end 130*a* of conduit 130 and a single opening 136 at a second end 130*b* of conduit 130, which is opposite from first end 130*a*. Opening 132 is proximate to side 130*c* of conduit 130 and opening 134 is proximate to opposite side 130*d* of conduit 130. Opening 136 is approximately halfway between sides 130*c* and 130*d*.

Conduit 130 further includes three main channels 138, 140, 142, which extend between first and second ends 130*a* and 130*b*. Channel 138 is adjacent side 130*c* and channel 140 is adjacent side 130*d*. Channel 142 is intermediate channels 138 and 140. Channel 138 is in fluid communication with opening 132, channel 140 is in fluid communication with opening 134 and channel 142 is in fluid communication with opening 136. Channels 138, 140, 142 typically have a cross-sectional area in a range from 0.05 to 0.50 square inch.

Conduit 130 further includes plural feeder channels 144 in fluid communication with channel 138 and extending between channel 138 and channel 142, and plural feeder channels 146 in fluid communication with channel 140 and extending between channel 140 and channel 142. Feeder channels 144, 146 are blocked, as indicated at 148, so that feeder channels 144, 146 are not in fluid communication with channel 142. Conduit 130 further includes plural feeder channels 150 extending between channel 138 and channel 142 and plural feeder channels 152 extending between channel 142 and channel 140. Feeder channels 150, 152 are in fluid communication with channel 142, but are blocked, as indicated at 154, such that feeder channels 150 and 152 are not in fluid communication with channels 138, 140.

Conduit 130 further includes plural heat transfer channels 155, arranged in discrete sections. Each section of heat transfer channels 155 is intermediate a feeder channel 144, 146 and an adjacent feeder channel 150, 152, and is in fluid communication with both the corresponding feeder channel 144, 146 and the corresponding feeder channel 150, 152. In FIG. 31, heat transfer channels 155 have a generally rectangular cross-section with relatively thin walls 156 separating adjacent channels 155 and are in parallel array. In alternate embodiments, the heat transfer channels may have other configurations, such as, for example, the parallel configuration described hereinabove with reference to FIGS. 8–13, the cross-hatched configuration described hereinabove with reference to FIGS. 14–20 or the chevron configuration described hereinabove with reference to FIGS. 21–30.

In FIG. 31, openings 132, 134 are depicted as inlet openings and opening 136 is depicted as an outlet opening. In operation, heat transfer fluid enters channels 138, 140 (which serve as main supply channels) through respective openings 132, 134. The inflow is depicted by respective arrows 158,160. The flow within channel 138 is depicted by arrows 162 and the flow within channel 140 is depicted by arrows 164. Heat transfer fluid from channel 138 flows through the various feeder channels 144 in the directions indicated by arrows 166. Similarly, heat transfer fluid from channel 140 flows through the various feeder channels 146 in the directions indicated by arrows 168. Because channels 144, 146 are blocked, as indicated at 148, fluid flows through each section of heat transfer channels 155 in a direction which is transverse with respect to directional arrows 166, 168 into the corresponding feeder channel 150, 152, which feeds the fluid into channel 142 (which serves as the main drain channel). Directional arrows 170 indicate the flow of heat transfer fluid through feeder channels 150 and directional arrows 172 indicate the flow of heat transfer fluid through feeder channels 152. Directional arrows 173 indicate the fluid flow in channel 142.

As shown in FIG. 31, each feeder channel 150, 152 forms a common drain feeder channel for two adjacent sections of heat transfer channels 155 and each feeder channel 144, 146 forms a common supply feeder channel for two adjacent sections of heat transfer channels 155, except for the feeder channels 144, 146 which are proximate to ends 130*a*, 130*b*. The cross-sectional areas of feeder channels 144, 146,150, 152 are typically in a range from 0.001to 0.100 square inch. The hydraulic diameters of heat transfer channels 155 are relatively small for enhanced heat transfer and are typically in a range from 0.015 to 0.100 inch. Each heat transfer channel 155 is relatively short (e.g., 1–6 inches) in relation to the overall length of conduit 130 (e.g., 12–60 inches) and the cross-sectional area of each channel 138, 140, 142, 144, 146, 150, 152 is relatively large compared to the cross-sectional area of each channel 155 (e.g., 5–100 times larger) to reduce unwanted pressure drops as fluid flows through heat transfer channels 155. Similarly, the length of each feeder channel 144, 146,150, 152 is relatively short (e.g., 3–12 inches) in relation to the length (e.g., 12–60 inches) of channels 138, 140, 142 to further inhibit unwanted pressure drops. Heat transfer between the fluid flowing through conduit 130 and an external fluid, such as air, flowing across the outside of conduit 130 occurs for the most part as the heat transfer fluid flows through channels 155.

Figure 32:
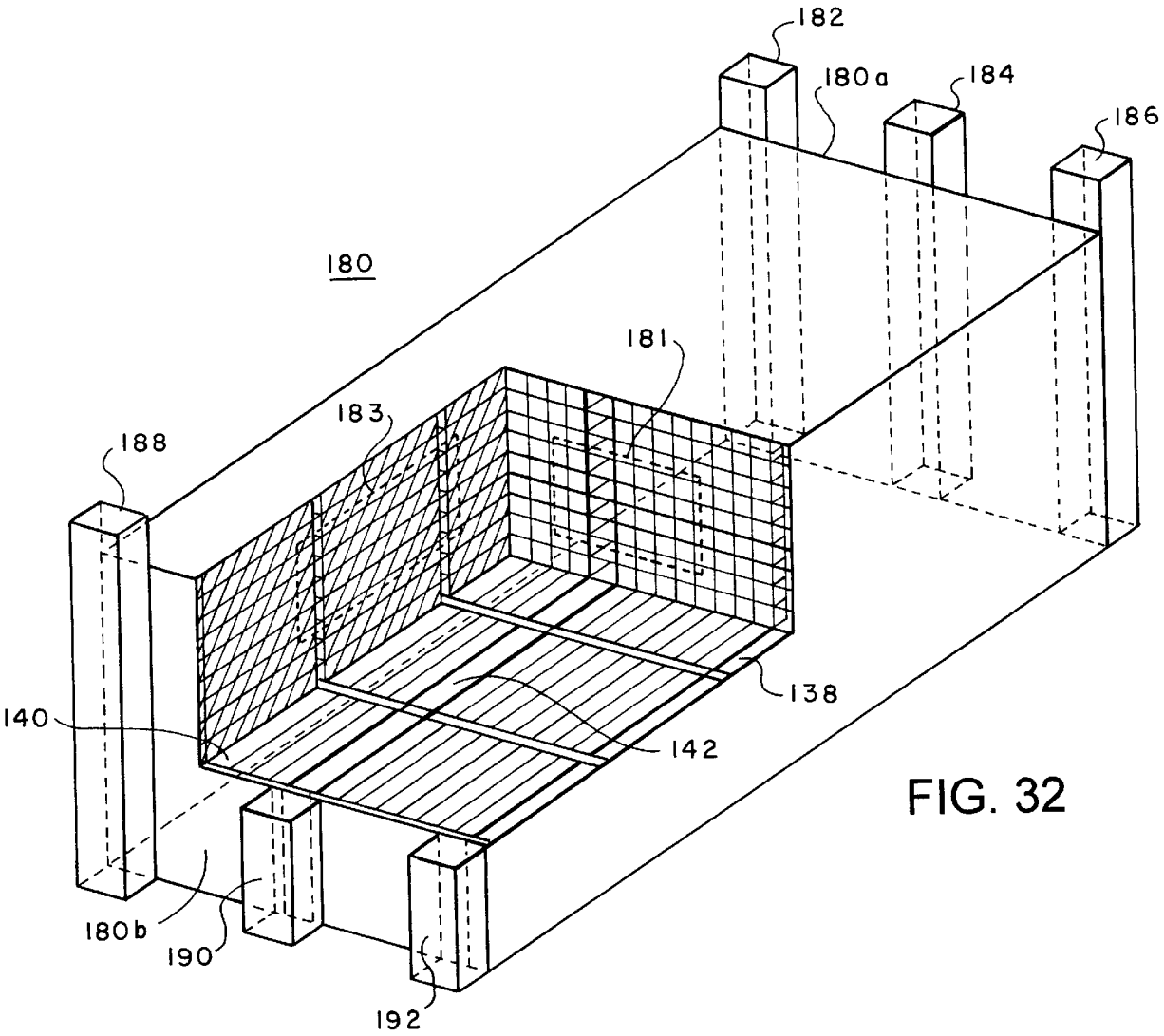
FIG. 32 is a perspective, partial cutaway view of a heat exchanger having plural conduits of the type shown in FIG. 31.
Figure 33:
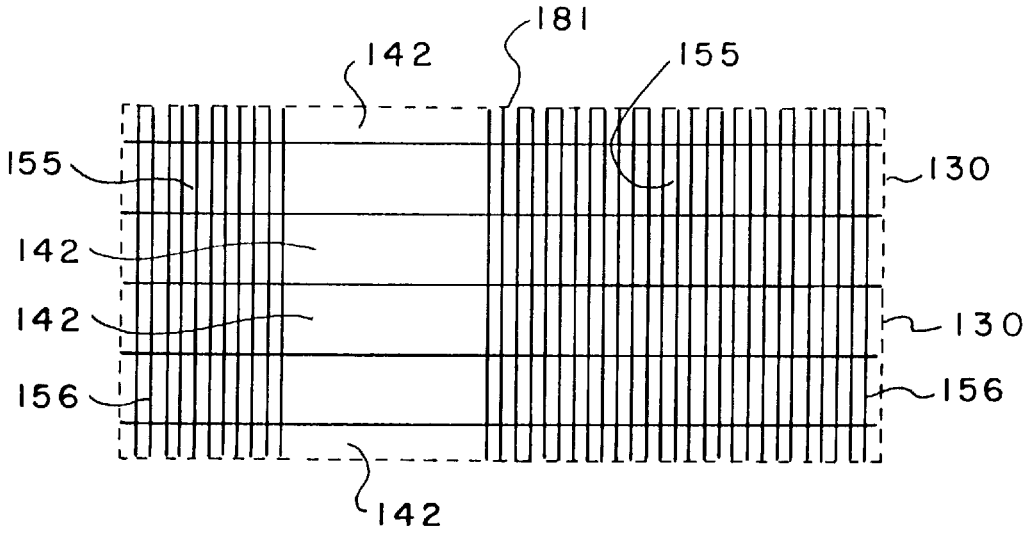
FIG. 33 is an interior elevation view of a portion of the heat exchanger of FIG. 32, looking along a major dimension of the heat exchanger.
Figure 34:
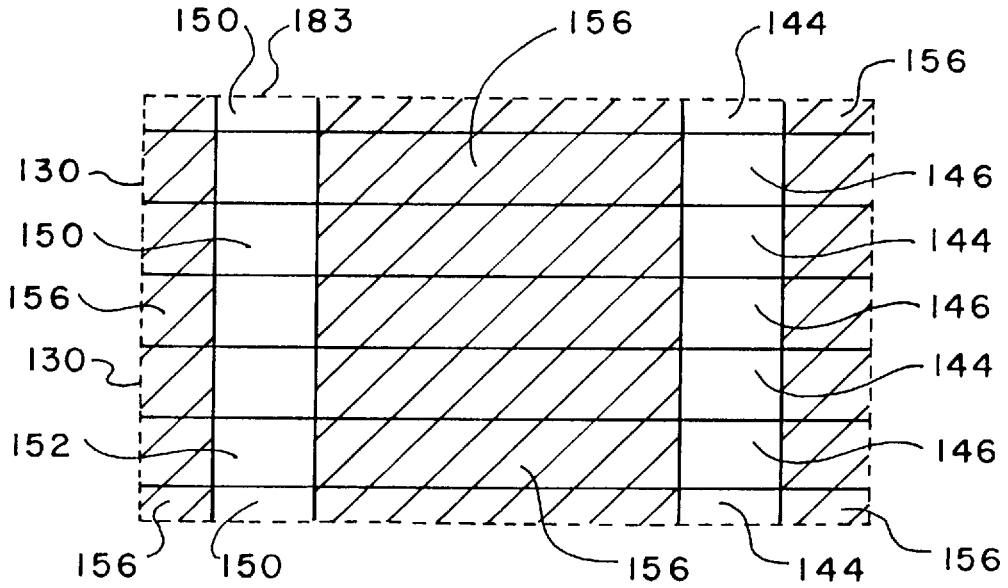
FIG. 34 is an interior elevation view of a portion of the heat exchanger of FIG. 32, looking along a minor dimension of the heat exchanger.

Referring also to FIGS. 32–34, a heat exchanger 180 is comprised of a plurality of conduits 130 in a vertical stack, such that respective major surfaces of conduits 130 are generally parallel. FIG. 33 is an elevation view of an interior rectangular portion of heat exchanger 180 bounded by broken lines 181 in FIG. 32. FIG. 34 is an elevation view of an interior rectangular portion of heat exchanger 180 bounded by broken lines 183. Alternate ones of conduits 130 are rotated 180°, such that heat transfer fluid flows through heat transfer channels 155 of each conduit 130 in counter-flow relationship to the flow of heat transfer fluid through heat transfer channels 155 of an adjacent conduit 130 in the stack. Heat exchanger 180 includes three inlet headers 182, 184, 186 at an inlet end 180*a* thereof and three outlet headers 188, 190, 192 at an outlet end 180*b* thereof. Selected first ones of conduits 130 are oriented such that their respective openings 132, 134 are in fluid communication with inlet headers 182 and 186, respectively, and their respective openings 136 are in fluid communication with outlet header 190. In this arrangement, the selected first ones of conduits 130 have two inlet openings and one outlet opening, as described hereinabove with reference to FIG. 31. Selected second ones of conduits 130 are oriented 180° with respect to the selected first ones of conduits 130, such that their respective openings 136 are in fluid communication with inlet header 184 and their respective openings 132, 134 are in fluid communication with outlet headers 188, 192, respectively. Therefore, the selected second ones of conduits 130 have one inlet opening and two outlet openings.

One skilled in the art will recognize that when opening 136 becomes the inlet opening and openings 132, 134 become the outlet openings, the flow of heat transfer fluid is in opposed relationship to the flow of heat transfer fluid when openings 132, 134 are inlet openings and opening 136 is the outlet opening. Not only is the flow of heat transfer fluid in opposed relationship within channels 138, 140 (which now function as the main drain channels), and in channel 142 (which now functions as the main supply channel), the flow is also opposite in feeder channels 144, 146 (which now function as drain feeder channels) in feeder channels 150, 152 (which now function as supply feeder channels) and in heat transfer channels 155. Conduits 130 in the vertical stack are oriented such that the flow of heat transfer fluid through heat transfer channels 155 of each conduit 130 is in counterflow relationship to the flow through heat transfer channels 155 of the adjacent conduit 130 above and heat transfer channels 155 of the adjacent conduit 130 below in the vertical stack.

In accordance with the present invention, an improved heat exchanger with relatively flat fluid conduits is provided. By configuring the heat transfer channels within each conduit to be relatively short in relation to the length of the corresponding conduit, the heat transfer channels can be made with relatively small hydraulic diameters for improved heat transfer efficiency without the unwanted pressure drops typically associated with prior art parallel flow heat exchanger conduits of relatively small hydraulic diameter. Such unwanted pressure drops are reduced by providing each conduit with supply and drain channels having substantially greater cross-sectional areas than the cross-sectional areas of the individual heat transfer channels, such that the supply and drain channels maintain sufficient fluid flow rate through the heat transfer channels without excessive pressure drops. The present invention has application in various types of heat exchangers used in air conditioning, refrigeration and chilled water systems. In accordance with at least one embodiment of the invention, heat transfer is further enhanced by configuring the heat transfer channels to promote turbulent mixing of the heat transfer fluid within the channels.

Various embodiments of the invention have now been described in detail, including the best mode for carrying out the invention. Since changes in and modifications to the above-described embodiments may be made without departing from the nature, spirit and scope of the invention, the invention is not to be limited to said details, but only by the appended claims and their equivalents.

I claim:

1. A heat exchanger having at least one conduit of non-circular cross-section adapted to accommodate passage of heat transfer fluid therethrough and support means for supporting said conduit, said conduit having a major dimension and a minor dimension, inlet and outlet openings, a supply channel extending generally along said major dimension and communicating with said inlet opening to direct heat transfer fluid flowing through said inlet opening into said conduit, a drain channel extending generally along said major dimension and communicating with said outlet opening to direct heat transfer fluid out of said conduit through said outlet opening, and plural heat transfer channels, each of which extends generally along said minor dimension between said supply channel and said drain channel, said major dimension being substantially greater than said minor dimension such that each heat transfer channel has a relatively short length compared to a length of said conduit along said major dimension, said supply channel and said drain channel each having a substantially greater cross-sectional area than each of said heat transfer channels, said heat transfer channels being adapted to direct heat transfer fluid from said supply channel to said drain channel in a generally transverse direction with respect to said major dimension.

2. The heat exchanger of claim 1 wherein said heat transfer channels are configured in parallel array, each of said heat transfer channels communicating between said supply channel and said drain channel.

3. The heat exchanger of claim 1 wherein said conduit is a relatively flat tube.

4. The heat exchanger of claim 3 wherein said supply channel and said drain channel have respective major axes which are parallel to said major dimension.

5. The heat exchanger of claim 4 wherein said supply channel and said drain channel are located on respective opposed sides of said tube and extend substantially the entire major dimension of said tube.

6. The heat exchanger of claim 1 wherein said supply channel and said drain channel have respective major axes which are generally parallel to said major dimension and each of said heat transfer channels has a major axis which is generally parallel to said minor dimension, the length of said conduit along said major dimension being at least six times the length of each heat transfer channel along its major axis.

7. The heat exchanger of claim 6 wherein the length of said conduit along said major dimension is at least thirty-six times the length of each heat transfer channel along its major axis.

8. The heat exchanger of claim 1 wherein the cross-sectional area of said supply channel is at least five times greater than the cross-sectional area of each of said heat transfer channels.

9. The heat exchanger of claim 8 wherein the cross-sectional area of said supply channel is at least one hundred times greater than the cross-sectional area of each of said heat transfer channels.

10. The heat exchanger of claim 1 wherein said supply and drain channels extend along respective opposed sides of said conduit, said inlet opening being located in one end of said conduit and proximate to one side of said conduit, said outlet opening being located in an opposite end of said conduit from said one end and proximate to an opposite side of said conduit from said one side, said one end being spaced apart from said opposite end by said major dimension, said one side being spaced apart from said opposite side by said minor dimension.

11. The heat exchanger of claim 10 wherein said one end has only one inlet opening and said opposite end has only one outlet opening.

12. The heat exchanger of claim 1 wherein each of said heat transfer channels has a hydraulic diameter of no more than 0.20 inch.

13. The heat exchanger of claim 1 wherein said conduit has opposed ends spaced apart by said major dimension and opposed sides spaced apart by said minor dimension, said conduit being assembled by bending a relatively flat plate upwardly along a first major axis thereof, folding a first portion of said plate along a second major axis thereof over a second portion of said plate to form one side of said conduit between said first and second major axes and joining opposed side edges of said plate to form an opposite side of said conduit from said one side.

14. In a heat exchanger, a conduit of non-circular cross-section adapted to accommodate passage of heat transfer fluid therethrough, said conduit having a major dimension and a minor dimension, inlet and outlet openings, a supply channel extending generally along said major dimension and communicating with said inlet opening to direct heat transfer fluid flowing through said inlet opening into said conduit, a drain channel extending generally along said major dimension and communicating with said outlet opening to direct heat transfer fluid out of said conduit through said outlet opening, and plural heat transfer channels, each of which extends generally along said minor dimension between said supply channel and said drain channel, said major dimension being substantially greater that said minor dimension such that each heat transfer channel has a relatively short length compared to a length of said conduit alone said major dimension, said supply channel and said drain channel each having a substantially greater cross-sectional area than each of said heat transfer channels, said heat transfer channels being adapted to direct heat transfer fluid from said supply channel to said drain channel in a generally transverse direction with respect to said major dimension.

15. The conduit of claim 14 wherein said supply channel and said drain channel have respective major axes which are generally parallel to said major dimension and each of said heat transfer channels has a major axis which is generally parallel to said minor dimension, said conduit having a length along said major dimension of at least six times the length of each heat transfer channel along its major axis.

16. The conduit of claim 14 wherein the cross-sectional area of said supply channel is at least five times greater than the cross-sectional area of each of said heat transfer channels.

17. The conduit of claim 14 wherein said supply and drain channels are located on respective opposed sides of said conduit, said inlet opening being located in one end of said conduit and proximate to one side of said conduit, said outlet opening being located in an opposite end of said conduit from said one end and proximate to an opposite side of said conduit from said one side, said one end being spaced apart from said opposite end by said major dimension, said one side being spaced apart from said opposite side by said minor dimension.

18. The conduit of claim 14 wherein said one end has only one inlet opening and said opposite end has only one outlet opening.

19. The heat exchanger of claim 14 wherein each of said heat transfer channels has a hydraulic diameter of no more than 0.20 inch.

20. The conduit of claim 14 wherein said conduit has opposed ends spaced apart by said major dimension and opposed sides spaced apart by said minor dimension, said conduit being assembled by bending a relatively flat plate upwardly along a first major axis thereof, folding a first portion of said plate along a second major axis thereof over a second portion of said plate to form one side of said conduit between said first and second major axes and joining opposed side edges of said plate to define an opposite side of said conduit from said one side.

* * * * *